United States Patent [19]

Obert et al.

[11] 4,255,237

[45] Mar. 10, 1981

[54] METHOD FOR PRODUCING A NOZZLE BODY BY ELECTROFORMING

[75] Inventors: Wolfgang Obert; Siegfried Dürr, both of Karlsruhe, Fed. Rep. of Germany

[73] Assignee: Kernforschungszentrum Karlsruhe Gesellschaft mit beschränkter Haftung, Karlsruhe, Fed. Rep. of Germany

[21] Appl. No.: 55,199

[22] Filed: Jul. 2, 1979

[30] Foreign Application Priority Data

Jul. 1, 1978 [DE] Fed. Rep. of Germany ..... 2828993

[51] Int. Cl.[3] ..... C25D 1/02; C25D 1/20

[52] U.S. Cl. ..... 204/9

[58] Field of Search ..... 204/3, 4, 9

[56] References Cited

U.S. PATENT DOCUMENTS

| | | | |
|---|---|---|---|
| 2,181,257 | 11/1939 | Arbogast | 204/9 |
| 2,613,178 | 10/1952 | Grant | 204/9 |
| 3,022,697 | 2/1962 | Kent | 204/9 |
| 3,512,252 | 5/1970 | Sargent | 204/9 |

FOREIGN PATENT DOCUMENTS

| | | | |
|---|---|---|---|
| 145099 | 4/1962 | U.S.S.R. | 204/9 |

*Primary Examiner*—T. M. Tufariello
*Attorney, Agent, or Firm*—Spencer & Kaye

[57] ABSTRACT

A method for producing, by electroforming, a nozzle body having an inner jacket surface whose slope can be made variable and, in particular, can be formed to change direction, along its axis of symmetry. An electrolytic metal deposit is applied to a previously produced base body having the negative shape of the nozzle body so as to form the positive nozzle body after which the base body is removed by chemical or mechanical means. The base body is made of a plurality of parts and these parts are aligned with respect to one another in such a manner that the tip of one part is centered and held coaxially with the axis of symmetry either in the tip or in the base surface of another part.

9 Claims, 13 Drawing Figures

FIG. 3a
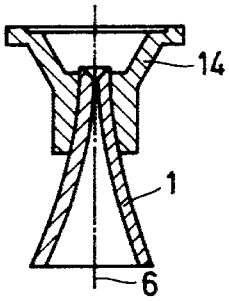
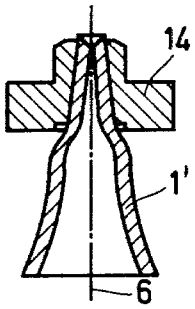
FIG. 3b
FIG. 3c
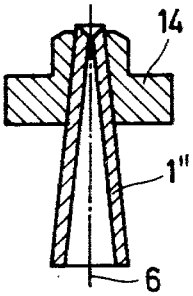
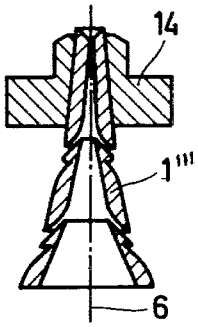
FIG. 3d
FIG. 3e
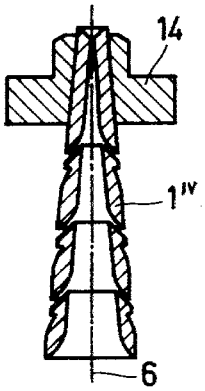
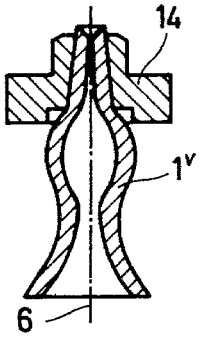
FIG. 3f

METHOD FOR PRODUCING A NOZZLE BODY BY ELECTROFORMING

BACKGROUND OF THE INVENTION

The present invention relates to a method for producing, by electroforming, a nozzle body having an inner jacket surface whose slope can be made variable and, in particular, can undergo a change in direction with respect to an axis of symmetry.

It has been found that for the generation of intensive cluster radiation (e.g. deuterium or gases) or to focus corpuscular radiation (e.g. liquid mediums), the configuration of the nozzles used is an important parameter. The conventional manufacture of metal nozzles has been found to be rather difficult because of the requirements which must be met for desired configuration, surface quality, reproducibility and number of items. According to the conventional manufacturing process, a good tip turner works, for example, about 12 to 14 working days to produce one copper trumpet nozzle. This does not take into account the possibility of rejects which are no rarity for such complicated workpieces that often have the narrowest of bores with diameters of less than 0.1 mm and a length of 20 to 40 mm.

Likewise, the use of glass nozzles has been found to be impractical because of the difficulties in precisely reproducing a given shape and in mounting the nozzles, particularly at low temperatures. The poorer conductivity of glass compared to metals may possibly be an additional problem.

The manufacture of metal nozzles, particularly copper nozzles, by means of a known electroforming process would meet all of the requirements if one could be assured of the precision of the reproduction of a given shape, the surface quality, the number of items produced and the reliability of the process with a very low number of rejects.

In the applicable art, the term "electroforming process" is understood to mean an electrolytic metal deposition in thicker layers on a prefabricated metallic or nonmetallic negative or base body, which constitutes a mold for the interior surface of the resulting nozzle. Generally, the material to be deposited is copper or nickel. The quantity of apparatus required to practice the method is only slightly greater than that for decorative metal refinement.

The difficulties in the manufacture of nozzles with very small diameters (e.g., 0.1 mm and less) according to the electroforming process lie in the lack of dimensional accuracy of the base body, particularly at the junctions at critical points near the narrowest nozzle cross sections where the slope changes or even reverses direction with respect to the axis of rotational symmetry of the nozzle body or of the base body.

SUMMARY OF THE INVENTION

It is therefore an object of the present invention to provide a method by which the base body for a nozzle to be produced according to the electroforming method can be manufactured accurately and, in particular, with dimensionally accurate transition regions.

This and other objects are accomplished according to the present invention by a method for producing, by electroforming, a nozzle body having an inner jacket surface whose slope can be made variable and, in particular, can change direction with respect to an axis of symmetry, wherein an electrolytic metal deposit is applied to a previously produced base body having the negative shape of the nozzle body, i.e., constituting a mold for the inner surface of the nozzle body, so as to form the nozzle body, which is a positive of the base body, after which the base body is removed from the nozzle by chemical or mechanical means. The base body is made of a plurality of parts and these parts are aligned with respect to one another in such a manner that the tip of one part is centered and held, either in the tip or in the base surface of another part, coaxially with the axis of symmetry of the base body.

A particular advantage of the present invention is that the nozzle bodies produced according to the method of the invention are suitable for generating a cluster beam or for focusing corpuscular radiation.

BRIEF DESCRIPTION OF THE DRAWINGS

FIGS. 3*a* through 3*f* are cross-sectional views of various types of specialized nozzle bodies which can be formed according to the invention.

DESCRIPTION OF THE PREFERRED EMBODIMENTS

Figure 1A:
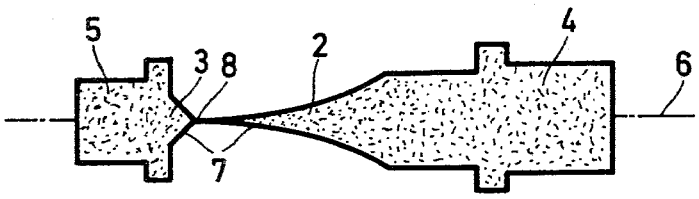
FIGS. 1*a* through 1*e* are cross-sectional views showing successive individual steps in the manufacture of a nozzle body according to a preferred embodiment of the invention.
Figure 1B:
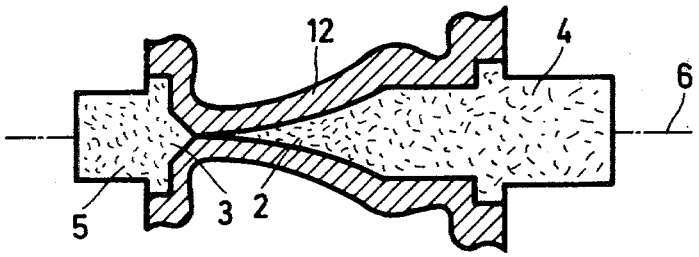
Figure 1C:
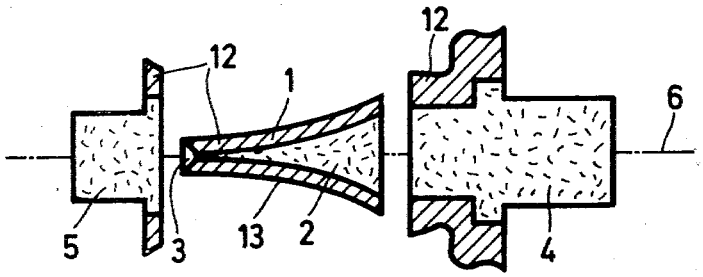
Figure 1D:
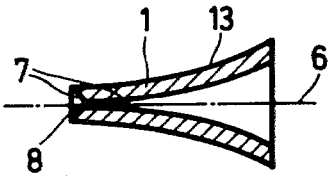
Figure 1E:
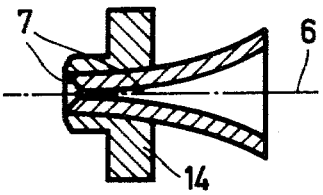

Referring now to the drawings, wherein like reference numerals designate identical or corresponding parts, the preferred method of producing, for example, a cluster beam nozzle 1, shown in finished form in FIG. 1*d*, from the negative including parts 2 and 3 is illustrated step by step in FIGS. 1*a* through 1*e* for the example of a trumpet nozzle. First, a base body negative having parts 2, 3 defining the desired beam nozzle 1, as well as supporting parts 4 and 5, is made of aluminum, e.g., an AlCuMgPb short-chip free-cutting alloy, as shown in FIG. 1*a*. Parts 4 and 5 serve to hold the negative defined by parts 2 and 3 in a centering device for the subsequent electroplating process. All parts 2 through 5 are aligned on an axis of rotational, or axial, symmetry 6 of the base body. The outer jacket face 7 of the two parts 2 and 3 will constitute the inner jacket face in the finished nozzle, as shown in FIGS. 1*d* and 1*e*.

Figure 2:
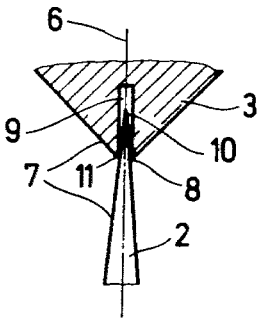
FIG. 2 is a cross-sectional detail view showing a critical junction in one embodiment of a base body having the form shown in FIG. 1*a*.

As can be seen in detail in FIG. 2, the nozzle negative in the simplest case, is composed of the two parts 2 and 3 which must be joined together, since for static reasons the two parts of the base body defining the nozzle inlet and nozzle outlet, which diverge from the point of narrowest nozzle cross section, cannot be manufactured in one piece. The nozzle-defining surfaces of the negative parts 2 and 3 are polished to a mirror finish in order that the wall of the inner jacket face 7 in the finished nozzle will have the lowest possible surface roughness. The dimensional accuracy of the narrowest nozzle cross section 8 is determined by the dimensional accuracy of the bore 9 which is aligned to be coaxial with the axis of rotational symmetry 6. The tip 10 of the one part 2 of the nozzle negative is introduced into and mounted in this bore 9. The final dimension of the narrowest nozzle cross section 8 can here by varied up to 0.01 mm by pushing parts 2 and 3 together to a greater or lesser degree, which can be observed and measured with the aid of a microscope.

The bore 9 need not necessarily be provided in a tip 11 of part 3; part 3 can alternatively present a base surface which is perpendicular to or lies at an obtuse angle (e.g. for supersonic nozzles) to the axis of rotational symmetry 6, disposed opposite the tip of part 2, with the bore 9 provided in that base surface.

In FIG. 1*b*, a layer of copper 12 is electrolytically deposited, or electroplated, onto the negative composed of parts 2 through 5, by means of an apparatus which is not shown in detail but is well known to those skilled in the art. The electrodeposited copper layer 12 here constitutes the unworked positive of the nozzle 1 to be produced. The outer surface 13 of nozzle 1 is then turned to the required outer dimensions.

As shown in FIG. 1*c*, the base body parts 2 and 3, and the associated parts of the electrodeposited positive layer 12 are then mechanically separated from body parts 4 and 5 and their associated parts of layer 12. The two parts 4 and 5 of the base body are here separated from parts 2 and 3 and from that part of the positive layer 12 which constitutes the positive nozzle body 1.

The parts 2 and 3 can be removed from nozzle body 1 by an etching procedure in a bath of 1 to 2 liters of about a 25% caustic soda solution. Depending on the nozzle configuration, this procedure takes 2 to 6 hours. Then, by ultrasonic cleaning in a bath containing Kaltron, the residual aluminum mud is eliminated from the nozzle interior down to the point of smallest cross section 8, indicated in FIG. 1*d*, which has a diameter of 0.1 mm, and the final nozzle positive 1 of FIG. 1*d* results. Kaltron is a product of Kalichemie, West Germany, and has the chemical formula $C_2Cl_3F_3$.

Next, the nozzle positive is immersed for a short time in a glazing pickle, where the surfaces 7 and 13 become completely glossy and now have the same surface quality as the parts 2 and 3 of the earlier negative. Additionally, the inner surface 7 may be hardened by means of a known chemical coating.

Depending on the intended use, the nozzle positive 1 need only be soldered into its intended mount 14, as shown in FIG. 1*e*.

Various and intricate nozzle shapes can be produced according to the method of the invention. Thus, FIG. 3*a* shows a trumpet nozzle 1, similar to that of FIG. 1, while FIG. 3*b* shows a bell nozzle 1', FIG. 3*d* a cone nozzle 1'' with an inner surface having a constant slope, FIG. 3*d* a trumpet nozzle 1''' with intermediate annular outlets, FIG. 3*e* a cone nozzle 1'$^{v}$ with intermediate annular outlets, and FIG. 3*f* a nozzle 1 $^{v}$ with an intermediate bulge, or expansion chamber. In each case, the nozzle 1 may be fastened in a special mount 14. In FIGS. 3*d* and 3*e*, the individual nozzle portions are fabricated together and only the upstream portion is fastened on the separately fabricated mount 14. The individual nozzle portions are strapped together by electroforming (not shown).

Figure 4:
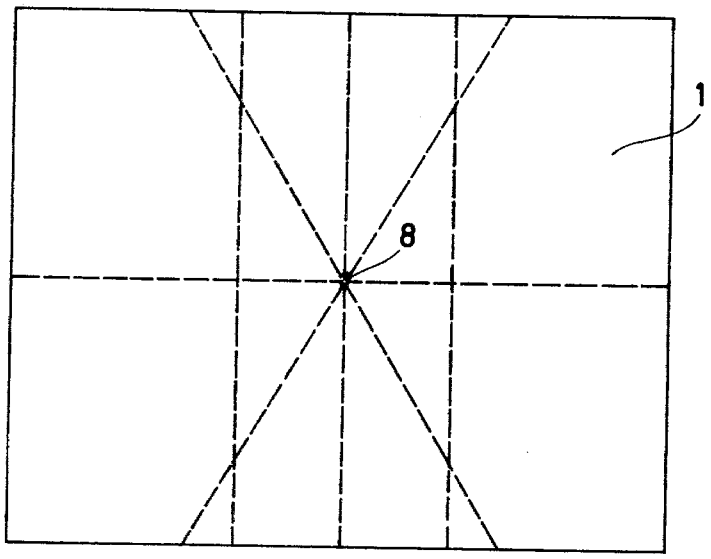
FIG. 4 is a greatly enlarged end view of the narrowest portion of a nozzle cross section.

FIG. 4 shows a microscopic view of the nozzle 1 with the narrowest nozzle cross section 8 for the case of a trumpet shaped configuration. The diameter of the narrowest nozzle cross section 8 is 0.035 mm and shows how accurately the method of the invention operates. The present invention makes it possible to achieve precise reproductions of a given nozzle profile, particularly also with critical points and junctions. A good surface qualtity in the interior, i.e., the jacket face 7, is also assured in the vicinity of the narrowest nozzle cross sections 8. It is also possible to produce with each copper nozzles which previously were difficult to work mechanically but which have highly desireable heat conductivity. The straight broken lines form the optical crossweb of the microscope. The cross section of the nozzles could also be elliptical, oval or rectangular e.g. for nozzles to be used for spattering surfaces with color.

It will be understood that the above description of the present invention is susceptible to various modifications, changes and adaptations, and the same are intended to be comprehended within the meaning and range of equivalents of the appended claims:

What is claimed is:

1. A method for producing a nozzle body for generating a cluster beam or focusing corpuscular radiation, comprising the steps of:

(a) fabricating a base body having the negative shape of the nozzle body to be produced, by providing a plurality of separately produced parts each having an axially symmetrical outer surface, providing in one of the parts of the base body a bore coaxial with its axis of symmetry, providing another of the parts of the base body with a tip which tapers progressively to its end, and mounting the tip of the other part centrally in the bore of the one part to place the parts in axial alignment and form the base body;

(b) electrolytically depositing a metal layer on the outer surface of the resulting base body to form the nozzle body; and (c) removing the plurality of parts of the base body from the nozzle body.

2. The method defined in claim 1 wherein the one part of the base body is provided with a tip, and the bore is provided in the apex of the tip of the one part.

3. The method defined in claim 1 wherein the one part of the base body is provided with a flat base surface, and the bore is provided in the base surface of the one part.

4. The method defined in claim 1 wherein said step (c) includes removing the plurality of parts of the base body by mechanical withdrawal.

5. The method defined in claim 1 wherein said step (c) includes removing the plurality of parts of the base body by chemical means.

6. The method defined in claim 1 wherein the base body is fabricated for producing a nozzle body whose interior surface has a slope which varies along the nozzle body axis.

7. The method defined in claim 1 wherein the base body is fabricated for producing a nozzle body whose interior surface has a slope which changes direction along the nozzle body axis.

8. The method defined in claim 1 wherein the diameter of said tip, at the point where it emerges from said bore, is equal to the internal diameter at the narrowest nozzle cross section required for generating a cluster beam or focusing corpuscular radiation.

9. The method defined in claim 8 wherein said diameter of said tip is no greater than about 0.1 mm.

* * * * *